United States Patent [19]

Nakajima

[11] Patent Number: 4,721,402

[45] Date of Patent: Jan. 26, 1988

[54] PAPER FEED MECHANISM INCLUDING LOWER PINCH ROLLERS

[75] Inventor: Hiroharu Nakajima, Tokyo, Japan

[73] Assignee: Canon Kabushiki Kaisha, Tokyo, Japan

[21] Appl. No.: 913,578

[22] Filed: Sep. 30, 1986

Related U.S. Application Data

[63] Continuation of Ser. No. 573,477, Jan. 24, 1984, abandoned.

[30] Foreign Application Priority Data

Feb. 3, 1983 [JP] Japan ..... 58-16826

[51] Int. Cl.[4] ..... B41J 13/03

[52] U.S. Cl. ..... 400/637; 400/637.3

[58] Field of Search ..... 400/636.3, 637, 637.1, 400/637.2, 637.3, 637.4, 637.5, 637.6, 639, 639.1, 639.2; 346/139

[56] References Cited

U.S. PATENT DOCUMENTS

| | | | |
|---|---|---|---|
| 924,460 | 6/1909 | Hess | 400/636.3 |
| 957,402 | 5/1910 | Yaw | 400/637.6 X |
| 1,062,569 | 5/1913 | McLaughlin | 400/637.6 X |
| 1,247,456 | 11/1917 | Schwartz | 400/636.3 |
| 1,988,189 | 1/1935 | Dobson | 400/637.4 X |
| 2,124,996 | 7/1938 | Anderson | 400/637.6 X |
| 3,292,762 | 12/1966 | Erickson | 400/636.3 X |
| 4,341,477 | 7/1982 | Theilen | 400/637.2 X |
| 4,486,108 | 12/1984 | Tanaka | 400/637.5 X |
| 4,498,795 | 2/1985 | Tatara | 400/639.1 X |
| 4,535,344 | 8/1985 | Noda | 346/139 |
| 4,602,883 | 7/1986 | Ozawa et al. | 400/637.1 |

FOREIGN PATENT DOCUMENTS

| | | | |
|---|---|---|---|
| 2603529 | 8/1976 | Fed. Rep. of Germany | 400/637.6 |
| 188043 | 3/1937 | Switzerland | 400/637.6 |

*Primary Examiner*—Ernest T. Wright, Jr.

*Attorney, Agent, or Firm*—Fitzpatrick, Cella, Harper & Scinto

[57] ABSTRACT

A paper feed mechanism comprises first and second support plates for supporting a paper feed roller and a rotary shaft for bringing a pinch roller into contact with and away from the paper feed roller. The rotary shaft extends through the first support plate and one end thereof abuts against the second support plate and the other end thereof engages with a lever mounted on the first support plate to define movement in a thrust direction. The rotary shaft is rotated with the rotation of the lever.

6 Claims, 2 Drawing Figures

PAPER FEED MECHANISM INCLUDING LOWER PINCH ROLLERS

This is a continuation of application Ser. No. 573,477, filed Jan. 24, 1984, now abandoned.

BACKGROUND OF THE INVENTION

1. Field of the Invention

The present invention relates to a paper feed mechanism used for a typewriter or the like.

2. Description of the Prior Art

It is an important problem in a typewriter to manufacture a high performance product with a low cost. It is, therefore, an important factor to reduce the number of manufacturing steps of the parts and the number of assembling steps in order to reduce personnel cost. When a paper feed mechanism of the typewriter is reviewed from those aspects, the number of parts is large, assembling time is long and many factors for cost reduction are involved.

SUMMARY OF THE INVENTION

It is an object of the present invention to provide a paper feed mechanism of a typewriter or the like which has the same performance as a prior art mechanism but has a smaller number of manufacturing steps for the parts, is simpler to assemble and of low manufacturing cost.

It is another object of the present invention to provide a printer comprising a platen, a pinch roller to be abutted against the platen and control means having a rotary shaft of a non-circular cross-section for bringing the pinch roller into contact with and away from the platen.

It is a further object of the present invention to provide a rotatable platen, a plurality of pinch rollers, a first lever for supporting the plurality of pinch rollers, support means for rockably supporting the first lever, a cam shaft arranged to abut against a portion of the first lever, and a second lever for rocking the cam shaft.

DETAILED DESCRIPTION OF THE PREFERRED EMBODIMENT

Figure 1:
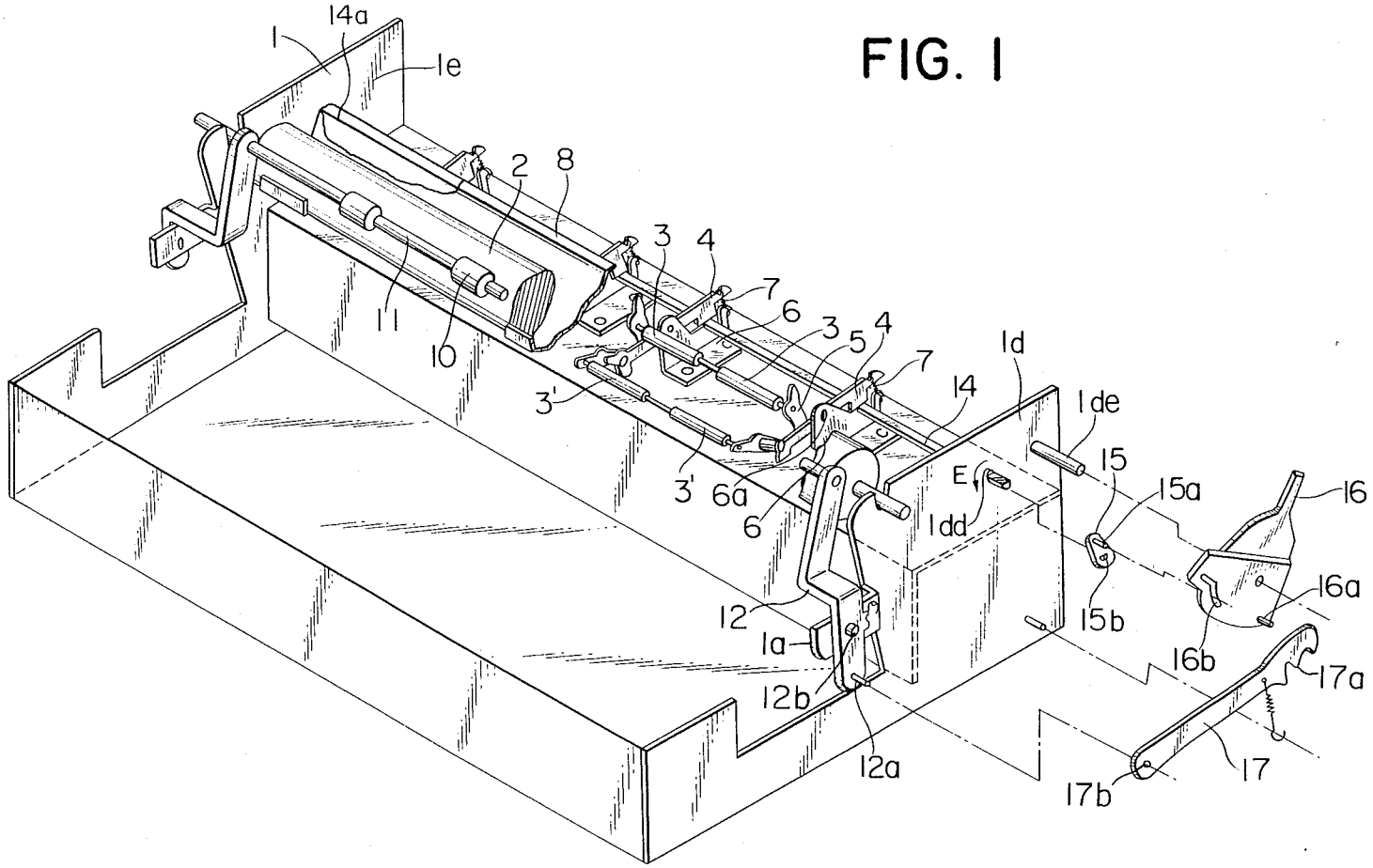
FIG. 1 is a perspective view of an embodiment of the present invention.
Figure 2:
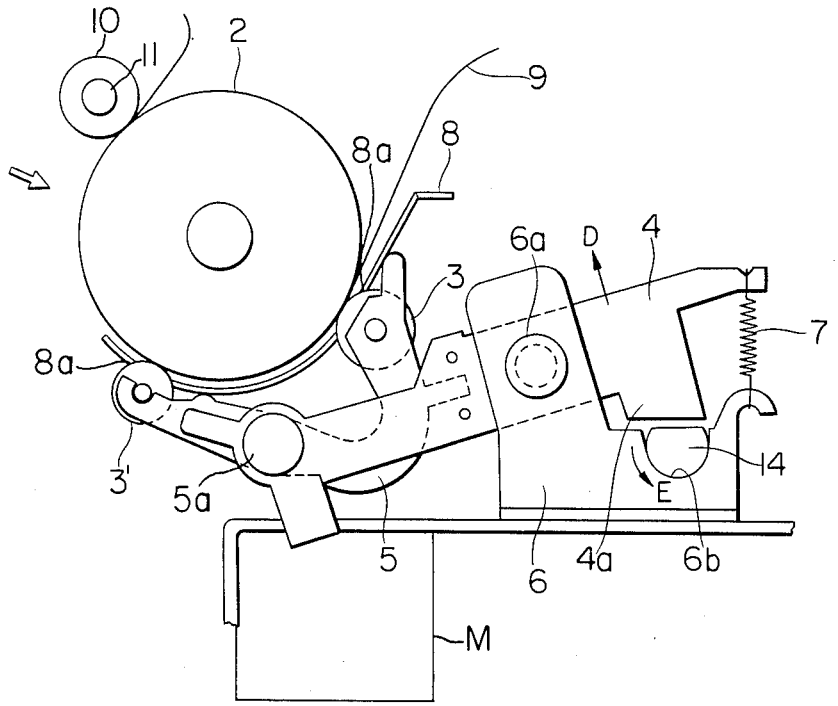
FIG. 2 is a fragmentary sectional view of the apparatus of FIG. 1.

Referring to FIGS. 1 and 2, numeral 1 denotes a generally U-shaped frame having support plates 1*d* and 1*e* which rotatably support a platen 2. The platen 2 is rotated by a drive force of a pulse motor M shown diagrammatically in FIG. 2 to function as a paper feed roller. Below the platen 2, two pairs of pinch rollers 3 and 3', respectively, are rotatably supported by arms 5 fixed to respective pinch levers 4 by pins 5*a* (FIG. 2). The pinch levers 4 are rotatable around pins 6*a* of brackets 6 fixed to the frame 1 and urge the pinch rollers 3 and 3' to the platen 2 by the force of springs 7. A paper guide 8 having apertures 8*a* formed at abutting areas of the pinch rollers 3 and 3' and the platen 2 is arranged under the platen 2, and a form 9 (FIG. 2) is fed as the platen 2 is rotated. A release shaft 14 which is a rotational shaft having a D-shaped section with an axially flat surface is arranged under the pinch levers 4. The release shaft 14 is rotatably supported by semi-cylindrical bearings 6*b* of the brackets 6. One end 14*a* of the shaft 14 abuts against the support plate 1*e* and the other end projects outward from a circular hole 1*dd* of the support plate 1*d*. An intermediate lever 15 is fitted to the projecting portion of the shaft 14 through an aperture 15*b* of the same contour as a cross-sectional shape of the shaft 14 so that the lever 15 is rotated in union with the shaft 14. The lever 15 has a projecting pin 15*a* which fits to a cam groove 16*b* of the release lever 16. The release lever 16 is rotatably supported by a shaft 1*de* formed on the support plate 1*d*. Thus, one end of the release shaft 14 abuts against the release lever 16 and the other end abuts against the support plate 1*e*, as described above. Accordingly, the movement of the shaft 14 in the direction of thrust is restricted without using locking screws, adhesive material or E-shaped lock rings.

If the release lever 16 is actuated against the springs 7 such that the release shaft 14 is rotated in the direction of arrow E, a circular portion of the release shaft 14 pushes up the projections 4*a* of the pinch levers 4. As a result, the levers 4 are rotated in the direction of arrow D around the axis of pin 6*a* and the pinch rollers 3 and 3' move away from the platen 2. When the release lever 16 is released, the pinch rollers 3 and 3' are again urged to the platen 2 by the force of the springs 7 so that the paper feed is permitted.

Numeral 10 denotes a paper retention roller which is rotatably supported by a shaft 11, which in turn is linked to the lever 17 through beam 12 pivoted at 12*b* to a tab 1*a* of frame 1 and which carries a pin 12*a* that extends into aperture 17*b* of lever 17, to move the paper retention roller 10 into contact with and away from the platen 2. More specifically, a groove 17*a* of the lever 17 engages with a pin 16*a* of the release lever 16 so that when the release lever 16 is actuated in one direction, the paper retention roller 10 moves away from the platen 2 and then the pinch rollers 3 and 3' move away from the platen 2.

As described hereinabove, according to the present invention, a low-cost paper feed mechanism for a typewriter which does not need an E-shaped lock ring or lock screw and is easy to assemble by using inexpensive shaft parts is provided.

While the shaft 14 is shown to have a D-shaped cross-section, the same advantage can be obtained with a different shape.

What I claim is:

1. A paper feed mechanism including lower pinch rollers, comprising:

a rotatable paper feed roller;

a plurality of pinch rollers;

lever means for pivotally supporting said plurality of pinch rollers;

a first side plate disposed at a predetermined position;

a shaft having a substantially D-shaped cross-section in the vertical direction relative to the axial direction thereof for engaging with said lever means, one end of said shaft abutting against said first side plate to define movement of the one end of said shaft in the axial direction thereof;

a second side plate for rotatably and pivotally supporting the other end of said shaft;

bracket means arranged between said first side plate and said second side plate for rotatably holding said shaft with a semi-cylindrical bearing portion;

an intermediate transmission member arranged on a side opposite said bracket means relative to said second side plate, having a substantially D-shaped hole into which said shaft is fitted and a pin member extending from said intermediate transmission member substantially in parallel with said shaft when said shaft is fitted into said D-shaped hole; and actuation means having a groove portion for engaging said pin member, disposed on said second side plate so as to confine said intermediate transmission member between said actuation means and said second side plate, and abutting against the other end of said shaft to define movement of the other end of said shaft in the axial direction of said shaft, and for rotating said shaft to bring said pinch rollers into contact with and away from said paper feed roller.

2. A paper feed mechanism including lower pinch rollers according to claim 1, further comprising means for urging said lever means toward said shaft.

3. A paper feed mechanism including lower pinch rollers according to claim 1, further comprising a retention roller arranged to be brought into contact with and away from said paper feed roller, and additional lever means arranged between said actuation means and said retention roller for bringing said retention roller into contact with and away from said paper feed roller in linked relation to the movement of said actuation means.

4. A paper feed mechanism including lower pinch rollers according to claim 1, wherein said groove portion of said actuation means comprises a cam groove and wherein said pin member is received in said cam groove.

5. A paper feed mechanism including lower pinch rollers according to claim 1 wherein said shaft having a D-shaped cross-section includes a flat portion on its circumference and wherein said lever means is formed with a flat portion configured to lie against said flat portion of said shaft when said shaft is rotated to bring said pinch rollers into contact with said paper feed rollers.

6. A paper feed mechanism including lower pinch rollers according to claim 2, wherein said urging means includes a spring mounted in tension between said lever means and said bracket means.

* * * * *